US009446269B2

(12) United States Patent
Shaik et al.

(10) Patent No.: US 9,446,269 B2
(45) Date of Patent: Sep. 20, 2016

(54) SYSTEM AND METHOD FOR FIRE SUPPRESSION

(71) Applicant: General Electric Company, Schenectady, NY (US)

(72) Inventors: Naseer Shaik, Hyderabad (IN); Pritesh Kasliwal, Salem, VA (US); Mohammed Afzal Khan, Hyderabad (IN)

(73) Assignee: General Electric Company, Schenectady, NY (US)

( * ) Notice: Subject to any disclaimer, the term of this patent is extended or adjusted under 35 U.S.C. 154(b) by 834 days.

(21) Appl. No.: 13/717,042

(22) Filed: Dec. 17, 2012

(65) Prior Publication Data

US 2014/0166319 A1 Jun. 19, 2014

(51) Int. Cl.
*A62C 37/36* (2006.01)

(52) U.S. Cl.
CPC ..... *A62C 37/36* (2013.01)

(58) Field of Classification Search
CPC ..... A62C 37/36; A62C 37/38; A62C 37/40
USPC ..... 169/46, 54–61, 23, 70
See application file for complete search history.

(56) References Cited

U.S. PATENT DOCUMENTS

| | | | | |
|---|---|---|---|---|
| 5,945,924 | A | 8/1999 | Marman et al. | |
| 5,947,207 | A * | 9/1999 | Conforti | A62C 37/42 169/47 |
| 6,401,487 | B1 | 6/2002 | Kotliar | |
| 7,012,517 | B2 * | 3/2006 | Mueller | G01C 21/22 340/524 |
| 7,207,392 | B2 | 4/2007 | Kotliar | |
| 2002/0083736 | A1 | 7/2002 | Kotliar | |
| 2003/0074917 | A1 | 4/2003 | Kotliar | |

FOREIGN PATENT DOCUMENTS

| | | | |
|---|---|---|---|
| JP | 06-126000 | | 5/1994 |
| JP | 2004255117 | A * | 9/2004 |

OTHER PUBLICATIONS

Jim Bisker, P.E., Protecting Workers From the Acute Effects of Carbon Dioxide Fire Extinguishing Systems Introduction, DOE/EH-0196, Issue 99-1, Apr. 1999, 4 pages.
Robert T. Wickham, P.E., Review of the Use of Carbon Dioxide Total Flooding Fire Extinguishing Systems, Wickham Associates, Aug. 8, 2003, 97 pages.
Super Fire Engg Pvt Lrd., Fire Solution, Re-engineering Fire Solutions, Designed by Techview Web Solutions, 2008, 3 pages.
FM 200 Clean Agent Suppression Systems, Products, 11 pages.
Accidents with CO2 Extinguishing Systems, ARIA News Flash, Dec. 2008, 2 pages.
Halons Technical Options Committee, Montreal Protocol, Jul. 1993, 87 pages.
Appendix B—Overview of Acute Health Effects, 9 pages.
Reclamation—Managing Water in the West, Facilities, Instructions, Standards, and Techniques vol. 5-12, CO2 System Operation and Maintenance, May 2005, 47 pages.
Carbon Dioxide As a Fire Suppressant: Examining the Risks, EPA, Feb. 2000, 54 pages.

* cited by examiner

*Primary Examiner* — Arthur O Hall
*Assistant Examiner* — Viet Le
(74) *Attorney, Agent, or Firm* — Barclay Damon, LLP

(57) ABSTRACT

A system and method for fire suppression proactively identifies persons present, during a fire, in a fire suppressant release area. The persons are identified using an electronic monitoring system. An fire suppression system using a suppressant that is effective but unsafe for humans is put into service only if no person is detected. In situations where a person is present, an alternate fire suppressant is released that is safe for humans.

7 Claims, 2 Drawing Sheets

SYSTEM AND METHOD FOR FIRE SUPPRESSION

BACKGROUND OF THE INVENTION

The subject matter disclosed herein relates to a fire suppression system and method, in particular, for controlling carbon dioxide ($CO_2$) based systems.

Various industrial sites, including, for example, power plants and manufacturing sites, are expected to run continuously with no unplanned shutdowns. Plants and equipment are typically built with the highest degree of safety in mind for protection against unexpected events. With respect to unforeseen fires, carbon dioxide-based fire suppressant constitutes a major fire extinguishing medium, apart from water hydrant and water sprinkler systems. A container that discharges carbon dioxide forms a quick blanket around the fire and thereby helps in fire extinction. Carbon dioxide-based fire protection systems can potentially pose a life threatening situation for workers in the release area if they fail to evacuate in time. Previous measures designed to address this risk include manual mechanical shut off methods to prevent carbon dioxide release, and alarms or loudspeaker announcements advising evacuation prior to the release.

The discussion above is merely provided for general background information and is not intended to be used as an aid in determining the scope of the claimed subject matter.

BRIEF DESCRIPTION OF THE INVENTION

A system and method for fire suppression proactively identifies persons present, during a fire, in a fire suppressant release area. The persons are identified using an electronic monitoring system. An fire suppression system using a suppressant that is effective but unsafe for humans is put into service only if no person is detected. In situations where a person is present, an alternate fire suppressant is released that is safe for humans.

In one embodiment, a fire suppression system comprises a processing system and a fire detector that are electrically connected. A person detector is also electrically connected to the processing system and detects people in a monitored area. A first container system comprises an unsafe fire suppressant, and a second container system comprises a safe fire suppressant. Both container systems are electrically connected to the processing system.

In another embodiment, a fire suppression system comprises a processing system and a fire detector electrically connected to the processing system for sending a fire signal to the processing system in response to detecting a fire. A database that is accessible by the processing system stores a list of persons entering and exiting a monitored area. A first container system comprises a carbon dioxide-based fire suppressant, and a second container system comprises a human-safe fire suppressant. Both containers are electrically connected to the processing system for releasing their fire suppressant in response to receiving a signal from the processing system.

In another embodiment, a method of fire suppression comprises automatically detecting a fire within a monitored area, automatically checking for a presence of one or more humans in the monitored area, and automatically releasing a carbon dioxide-based fire suppressant into the monitored area if there are no humans present there.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1:
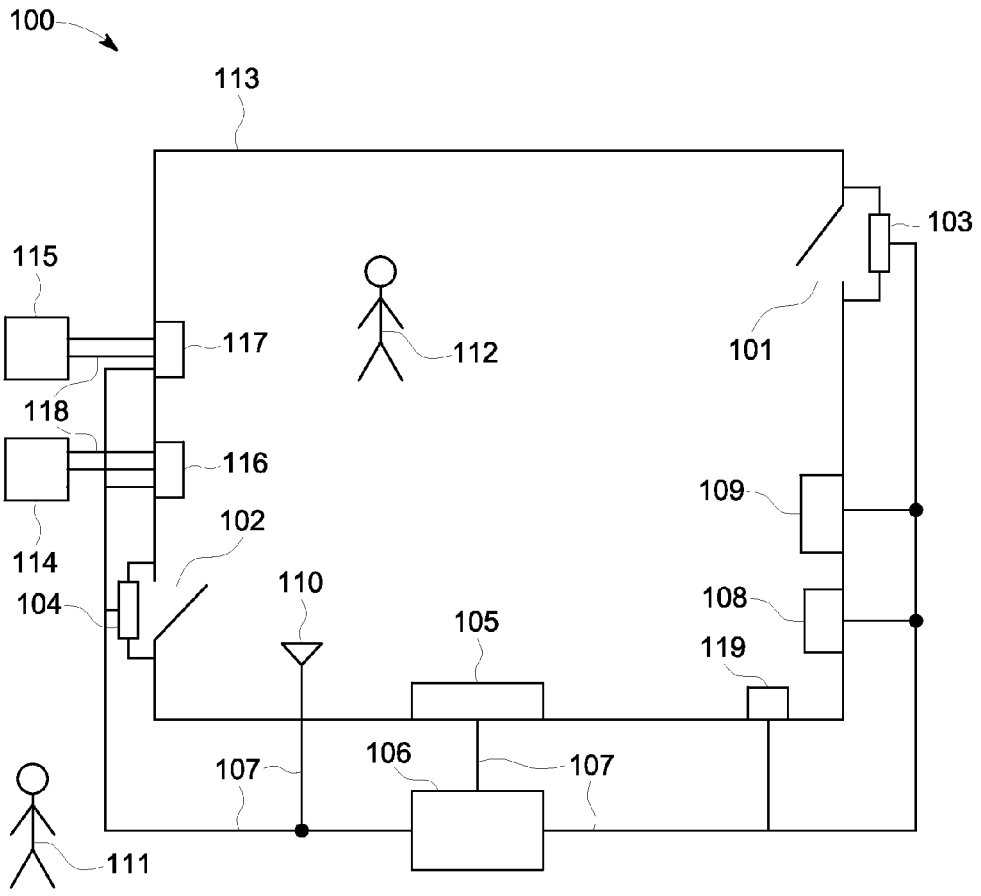
FIG. 1 is a schematic diagram of a fire suppression system used for monitoring an area.

With respect to FIG. 1 there is illustrated one embodiment of a fire suppression system 100 comprising an electronic system having electric circuits for detecting, identifying, and recording the presence of persons 112 within a monitored area 113. Fire suppression system 100 includes a fire detector 105, electronic ID readers or detectors 103, 104, RFID detector 110, an audible and visible alarm 119, fire suppressant containers 108, 109, fire suppressant tank outlets 116, 117, all electrically connected to fire control processing system 106 over communication channel 107. A person 111 not within monitored area 113 enters monitored area 113 through entry/exit points 101, 102. Similarly, a person 112 within monitored area 113 exits monitored area 113 through entry/exit points 101, 102. Fire suppressant tanks 114, 115 for flooding monitored area 113 are connected to fire suppressant tank outlets 116, 117, respectively, via pipes 118.

Electronic ID readers or detectors 103, 104 may be deployed at each entry/exit point 101, 102 for detecting entry and exit by persons into and out of monitored area 113. Such devices may comprise employee badge readers, which can be card-based magnetic strip reading devices or bar code reading devices; text input devices such as keypads or other input devices for inputting ID numbers or names; radio frequency identification (RFID) reading devices which comprise circuitry for detecting an RFID source worn or carried by an employee, worker or other person; a facial imaging and recognition device which includes a digital camera for capturing an image of a person's face and facial recognition programming for identifying the person based on the captured facial image; a retinal imaging and recognition device which captures an image of a portion of a person's eye for identifying the person based on retinal patterns; a voice recognition device for receiving a voice sample from a person in order to identify the person based on voice characteristics; a fingerprint reader; a hand print reader; or any combination thereof. The ID readers or detectors 103, 104 are placed at each entry/exit point 101, 102 and contain electric circuits for detecting and reading ID information from each person entering and exiting monitored area 113. The ID information so detected is electronically stored in electronic memory of fire control processing system 106 or in memory that is accessible by fire control processing system 106.

Instead of, or in combination with, the readers and detectors just described, an RFID detection system may be deployed within monitored area 113 to track personnel that are present within monitored area 113 by detecting RFID devices worn or carried by personnel within monitored area 113. Persons entering within range of RFID detector 110 are detected, identified, and recorded as being present in monitored area 113. Conversely, persons that depart monitored area 113 are detected, identified, and recorded as being no longer present in range of RFID detector 110 in monitored area 113. Such detection systems, as described herein, can be used to store the detected identification data and used in conjunction with, for example, an employee database that may be part of a standard security system employed by a company for controlling entry to monitored areas 113 of work sites by authorized personnel. The fire control processing system 106 may be configured to have access to such a security system database. Each electronic ID reader or detector 103, 104, or the personnel ID data generated thereby, is accessible by fire control processing system 106 for determining, at any time, the presence of persons within monitored area 113.

Fire control processing system 106 can be configured to be connected to, or part of, such a standard security system for tracking personnel that enter and exit monitored area 113. Databases utilized for tracking such personnel can be electrically connected to fire control processing system 106 such that fire control processing system 106 can freely access such data to determine whether there are persons who have entered but not exited the monitored area 113 via the entry/exit points 101, 102. In the embodiment shown in FIG. 1, the fire control processing system 106 directly manages and is directly connected to the electronic ID readers and detectors 103, 104 using communication channel 107. In the embodiment shown in FIG. 1, fire control processing system 106 comprises a processor and memory for managing personnel ID data and for storing and executing programs according to the algorithms described herein.

The fire control processing system 106 can be located proximate to or remote from monitored area 113. Communication channel 107 represents either a wired communication channel 107 or a wireless communication channel. Wired communication channel 107 can be implemented as a networked communication channel, such as an Ethernet or USB communication channel, or a privately designed communication channel. Similarly, the communication channel implemented as a wireless communication channel can be implemented as a WiFi, cellular, or a privately designed wireless communication channel. Fire control processing system 106 may comprise a microcontroller, memory, and electric circuits for executing a stored computer program triggered by reception of the fire condition signal from fire detector 105. Fire control processing system 106 may be embodied in an application executed on a general purpose processing system such as a PC or laptop, a site wide server, or a network-based system remotely located from monitored area 113 and communicating, over communication channel 107 implemented as an internet connection, with fire detector 105 or other detection devices proximate to monitored area 113. In one embodiment, communication channel 107 may comprise, in various combinations, an internet connection, a cellular network connection, a wired network connection and a WiFi connection interoperating to maintain communication between detection devices proximate to monitored area 113 and fire control processing system 106 connected remotely to such devices.

In one embodiment, electronic ID readers and detectors 103, 104 are not configured to identify each person entering and exiting monitored area 113. Rather, the electronic ID readers and detectors 103, 104 track persons who enter and exit monitored area 113 without identifying such persons and merely keep track of a total count of persons entering and exiting monitored area 113. Such devices can comprise one or more of the readers and detectors described above and can further include other means for tracking entry and exit of persons from monitored area 113, such as turnstiles, infrared detectors, and light beam detectors, for example. An RFID detection system using RFID detector 110 can anonymously detect persons carrying or wearing generic RFID tags. RFID detector 110 can be replaced or used together with a motion detector or infrared detector for determining that one or more persons are present or not present within monitored area 113. Any such detection devices communicate detection data to fire control processing system 106 as described above to indicate whether detection data indicates the presence of one or more persons within monitored area 113. Detected motion by a motion detector, or a total entry count higher than an exit count at entry/exit points 101, 102 are further examples of data indicating the presence of persons in monitored area 113.

The fire suppressant container 109 is designated to store a human-safe fire suppressant, and container 108 is designated to store a carbon dioxide-based fire suppressant, wherein each container is connected to fire control processing system 106 using communication channel 107. Each of fire suppressant containers 108, 109 comprise an electrically actuable valve for releasing its contents under pressure upon receiving an electric signal from fire control processing system 106 over communication channel 107 to open its valve. Similarly, the valves in fire suppressant containers 108, 109 close in response to receiving a second electric signal from fire control processing system 106 over communication channel 107 for terminating release of fire suppressant. The fire suppression system 100 is automated and is programmed to constantly monitor an area 113 such as a region on a factory floor, or other commercial or private premises wherein various personnel may enter and exit via one or more entry/exit points 101, 102. The premises may be occupied by at least one person intermittently, during scheduled times, or at all times. A programmed operation of fire suppression system 100 is triggered upon receiving a signal at fire control processing system 106 from fire detector 105 that a fire condition has been detected, as described below.

In one embodiment, one or more fire detectors such as fire detector 105 is powered via battery power or permanent site power supply, and constantly monitors area 113. Upon detecting a fire condition, fire detector 105 issues an electric signal to fire control processing system 106 over communication channel 107. Fire detector 105 may comprise any conventional fire detection means such as a smoke detector or a heat detector. In one embodiment, a smoke detector may comprise a photodetector that monitors clarity of the air within smoke detector and is triggered when fire generated smoke particles affect transmissivity of the air within the detector above or below a preset threshold. In another embodiment, a smoke detector may comprise a ionization detector that monitors the air within the smoke detector and is triggered when fire generated smoke particles affect conductivity of ionized air within the smoke detector above a certain preset threshold. The fire detector 105 may also comprise a combination of the above types of smoke detectors. In another embodiment, fire detector 105 may be a heat detector, such as a temperature reading electronic heat detector, or an eutectic alloy (melting switch) heat detector, or a rate-of-rise heat detector, or a combination of the above. In one embodiment, the fire detection mechanism may be powered by connecting it to a permanent building power supply (mains), a battery, or capacitor-based power supply, or in any combination thereof, and using any combination thereof as a backup power supply. The preceding examples of fire detection mechanisms are not to be interpreted in a limiting sense, and are described herein as exemplary detection mechanisms useable with embodiments of the present invention. Any other type of fire detection device used in fire suppression system 100 is contemplated as an embodiment of the present invention.

The human-safe fire suppressant in fire suppressant container 109 may include a Dry Chemical Powder (DCP) fire extinguishing agent, or another fire suppressant that is safe for humans, to be used when one or more persons are detected inside monitored area 113 during a fire condition. Fire suppressant container 109 using a DCP fire suppressant is available in portable cylinders pressurized with nitrogen. Similarly, fire suppressant container 108 using a carbon dioxide-based fire suppressant is available in portable pressurized cylinders. In one embodiment, large fire suppressant tanks 114, 115 are connected with piping system 118 to fire suppressant tank outlets 116, 117 respectively. The outlets are capable of selectively flooding monitored area 113 under control of an electric signal from fire control processing system 106 over communication channel 107 to either or both of fire suppressant tank outlets 116, 117. In this embodiment, fire suppressant tank 114 comprises a carbon dioxide-based fire suppressant in sufficient quantities for flooding monitored area 113, while fire suppressant tank 115 comprises a fire suppressant safe for humans in sufficient quantities for flooding monitored area 113, such as the DCP described above. Both fire suppressant tank outlets 116, 117 comprise valves selectively electrically actuable, individually or together, under control from an electric signal received from fire control processing system 106 over communication channel 107 to open and release fire suppressant from the fire suppressant tanks 114, 115, respectively, through a corresponding pipe 118 and through fire suppressant tank outlets 116, 117 for flooding monitored area 113. Similarly, the valves in fire suppressant tank outlets 116, 117 are selectively electrically actuable to close, for terminating the release of fire suppressant into monitored area 113 upon receiving a second signal from fire control processing system 106.

The DCP in fire suppressant container 109 and in fire suppressant tank 115 may comprise monoammonium phosphate. Monoammonium phosphate is a well-known fire suppressant and is non-toxic to human beings. In the event that carbon dioxide has been released, or carbon dioxide is otherwise present, and a person is in, or enters, the monitored area 113 during a fire condition state, the DCP from fire suppressant container 109 or from fire suppressant tank 115 may be released into monitored area 113 as described below.

Figure 2:
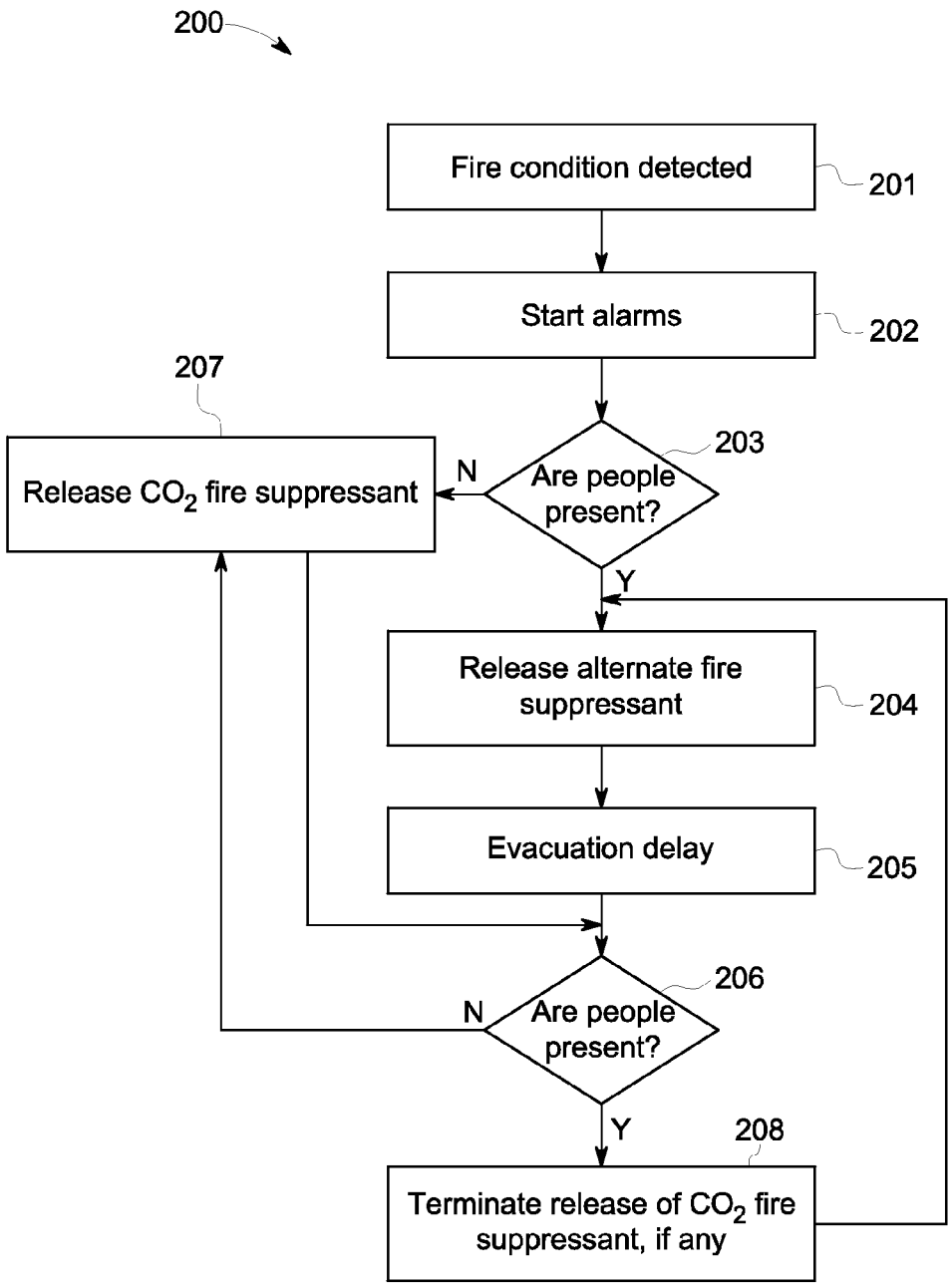
FIG. 2 is a flow chart of a method for operating the fire suppression system of FIG. 1.

With reference to FIG. 2, there is illustrated a fire control processing system algorithm 200 performed by fire control processing system 106 according to a program stored in a memory of fire control processing system 106. As described above, fire detector 105 constantly monitors area 113 for a fire condition. When fire detector 105 detects a fire condition, it transmits an electric signal over communication channel 107 to fire control processing system 106 which interprets the signal as a fire condition detected signal at step 201. At step 202, fire control processing system 106 triggers an audible and visible alarm 119 in monitored area 113 by sending an electrical signal to alarm 119 over communication channel 107. At step 203, fire control processing system 106 determines if one or more people are present in monitored area 113 as described above. For example, fire control processing system can access an ID information database to determine that people who have entered monitored area 113 have not yet exited, that a total entry count is less than a total exit count, that RFID detector 110 is currently detecting RFID tags in monitored area 113, or that a motion detector is currently detecting motion in monitored area 113.

If fire control processing system 106 determines that one or more people are present in monitored area 113, then at step 204 fire control processing system 106 sends an electric signal over communication channel 107 to human-safe fire suppressant container 109, or to human-safe fire suppressant tank outlet 117, or both, which causes corresponding valves to open and release human-safe fire suppressant from container 109 into monitored area 113, and/or from tank 115 through fire suppressant tank outlet 117 for flooding monitored area 113. A programmed delay occurs at step 205 for a preselected duration to allow time for people present in monitored area 113 to evacuate. At step 206, fire control processing system 106 checks to determines if people are present in monitored area 113. If fire control processing system 106 determines that people are still present in monitored area 113 then the human-safe fire suppressant continues to be released at step 204 until it is depleted, manually shut off, or the fire control processing system no longer detects a fire condition.

If fire control processing system 106 determines at step 206 that people are no longer present in monitored area 113, then the fire control processing system 106 sends an electric signal over communication channel 107 to carbon dioxide-based fire suppressant container 108, or to carbon dioxide-based fire suppressant tank outlet 116, or both, which causes the corresponding valves to open and release carbon dioxide-based fire suppressant from container 108 into monitored area 113, and/or from fire suppressant tank 114 for flooding monitored area 113 through fire suppressant tank outlet 116. The release of carbon dioxide-based fire suppressant at step 207, following decision step 206, may include fire control processing system 106 sending a second electric signal over communication channel 107 to fire suppressant container 109, or to fire suppressant tank outlet 117, or both, to close their valves and terminate release of the human-safe fire suppressant, or the human-safe fire suppressant can continue to be released together with the carbon dioxide-based fire suppressant. After step 207, at step 206, fire control processing system 106 determines if people are present in monitored area 113. If fire control processing system 106 determines that people are still no longer present in monitored area 113 then the carbon dioxide-based fire suppressant continues to be released at step 207 until it is depleted, manually shut off, the fire control processing system no longer detects a fire condition, or until fire control processing system 106 detects that people are present at step 206.

If fire control processing system 106 determines at step 206 that people are present in monitored area 113 after a release of carbon dioxide-based fire suppressant at step 207, then, at step 208 the fire control processing system 106 sends a second electric signal over communication channel 107 to carbon dioxide-based fire suppressant container 108, or to carbon dioxide-based fire suppressant tank outlet 116, or both, which causes the corresponding valves to close and terminate release of the carbon dioxide-based fire suppressant from container 108 and/or from fire suppressant tank 114 into monitored area 113. At step 204, if the human-safe fire suppressant container 109 and/or fire suppressant tank outlet 117 was not closed, the human-safe fire suppressant continues to be released until it is depleted, manually shut off, or the fire control processing system no longer detects a fire condition. If the human-safe fire suppressant container 109 and fire suppressant tank outlet 117 were closed, then fire control processing system 106 again sends an electric signal over communication channel 107 to human-safe fire suppressant container 109, or to human-safe fire suppressant tank outlet 117, or both, which causes corresponding valves to open and again release human-safe fire suppressant from container 109 into monitored area 113, and/or from tank 115 through fire suppressant tank outlet 117 for flooding monitored area 113. The fire control processing system algorithm 200 then continues through to step 206 as described above.

Returning back to step 203, if, after receiving a fire condition detected signal at step 201 and triggering the alarm at step 202, fire control processing system 106 determines that no people are present in monitored area 113, then at step 207 the fire control processing system 106 sends an electric signal over communication channel 107 to carbon dioxide-based fire suppressant container 108, or to carbon dioxide-based fire suppressant tank outlet 116, or both, which causes the corresponding valves to open and release carbon dioxide-based fire suppressant from container 108 into monitored area 113, and/or from fire suppressant tank 114 for flooding monitored area 113 through fire suppressant tank outlet 116. In one embodiment, the release of carbon dioxide-based fire suppressant at step 207 may include fire control processing system 106 also sending an electric signal over communication channel 107 to fire suppressant container 109, or to fire suppressant tank outlet 117, or both, to simultaneously release the human-safe fire suppressant into monitored area 113 together with the carbon dioxide-based fire suppressant. After step 207, at step 206, fire control processing system 106 determines if people are present in monitored area 113, and the algorithm continues as described above.

In view of the foregoing, embodiments of the invention provide an automatic fire suppressant release system designed to protect people in the vicinity of the fire from hazardous fire suppressants. A technical effect is to automate the fire suppressant system without requiring manual mechanical shut off of fire suppressants that are hazardous to people.

As will be appreciated by one skilled in the art, aspects of the present invention may be embodied as a system, method, or computer program product. Accordingly, aspects of the present invention may take the form of an entirely hardware embodiment, an entirely software embodiment (including firmware, resident software, micro-code, etc.), or an embodiment combining software and hardware aspects that may all generally be referred to herein as a "service," "circuit," "circuitry," "module," and/or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Program code and/or executable instructions embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer (device), partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fire suppression system comprising:

a processing system;

a fire detector for detecting a fire within a monitored area, the fire detector electrically connected to the processing system, wherein the fire detector comprises a first electric circuit for sending a fire signal to the processing system in response to detecting the fire within the monitored area;

a person detector for detecting a presence of one or more persons in the monitored area, the person detector electrically connected to the processing system, wherein the person detector comprises a second electric circuit for sending a no-person-present signal if no persons are detected in the monitored area and for sending a person-present signal if one or more persons are detected in the monitored area;

a first container system comprising an unsafe fire suppressant, the first container system electrically connected to the processing system, wherein the first container system comprises a first mechanism for releasing the unsafe fire suppressant into the monitored area in response to a first electric signal received from the processing system, wherein the processing system is programmed to transmit a first electric signal to the first container system in response to receiving the fire signal from the fire detector and the no-person-present signal from the person detector; and a second container system comprising a safe fire suppressant, the second container system electrically connected to the processing system, wherein the second container system comprises a second mechanism for releasing the safe fire suppressant into the monitored area in response to a second electric signal received from the processing system, and wherein the processing system is programmed to transmit the second electric signal to the second container system in response to receiving the fire signal from the fire detector and the person-present signal from the person detector.

2. The fire suppression system of claim 1, wherein the person detector comprises a radio frequency identification detector, a card magnetic strip reading device, a bar code reader, a text input device, a radio frequency identification detector, a facial imaging device, a retinal imaging device, a voice recognition device, a fingerprint reader, a hand print reader, or a combination thereof.

3. The fire suppression system of claim 2, wherein the radio frequency identification detector comprises a circuit for detecting a presence of one or more persons in the monitored area having a radio frequency identification tag.

4. The fire suppression system of claim 2, wherein the safe fire suppressant comprises monoammonium phosphate.

5. The fire suppression system of claim 1, further comprising a database for storing a list of persons entering and exiting a monitored area, the database being accessible by the processing system.

6. A fire suppression system comprising:

a processing system;

a fire detector for detecting a fire within a monitored area, the fire detector electrically connected to the processing system for sending a fire signal to the processing system in response to detecting the fire;

a database for storing a list of persons entering and exiting a monitored area, the database being accessible by the processing system;

a first container system comprising a carbon dioxide-based fire suppressant, the first container system electrically connected to the processing system for releasing the carbon dioxide-based fire suppressant in response to receiving a first signal from the processing system;

a second container system comprising a human-safe fire suppressant, the second container system electrically connected to the processing system for releasing the human-safe fire suppressant in response to receiving a second signal from the processing system, wherein the processing system comprises a circuit for sending the first electric signal to the first container system in response to receiving the fire signal and determining that all persons who entered the monitored area have exited the monitored area, and wherein the processing system is configured to send the second electric signal to the second container system in response to determining that not all persons who entered the monitored area have exited the monitored area.

7. The fire suppression system of claim 6, further comprising a radio frequency identification detector electrically connected to the database, the radio frequency identification detector comprising a circuit for detecting radio frequency identification tags carried or worn by persons entering and exiting the monitored area and for transmitting identification data detected from the tags to the database.

* * * * *